US009988237B1

(12) United States Patent
Arguedas et al.

(10) Patent No.: US 9,988,237 B1
(45) Date of Patent: Jun. 5, 2018

(54) ELEVATOR MANAGEMENT ACCORDING TO PROBABILISTIC DESTINATION DETERMINATION

(71) Applicant: International Business Machines Corporation, Armonk, NY (US)

(72) Inventors: Juan Gabriel Rodriguez Arguedas, San Jose (CR); Edgar Adolfo Zamora Duran, Santo Domingo (CR); Roxana Monge Nunez, San Jose (CR); Franz Friedrich Liebinger Portela, Heredia (CR)

(73) Assignee: International Business Machines Corporation, Armonk, NY (US)

( * ) Notice: Subject to any disclaimer, the term of this patent is extended or adjusted under 35 U.S.C. 154(b) by 2 days.

(21) Appl. No.: 15/363,306

(22) Filed: Nov. 29, 2016

(51) Int. Cl.
*B66B 1/24* (2006.01)
*B66B 1/46* (2006.01)
*B66B 3/00* (2006.01)

(52) U.S. Cl.
CPC ..... *B66B 1/2408* (2013.01); *B66B 1/468* (2013.01); *B66B 3/006* (2013.01); *B66B 2201/223* (2013.01); *B66B 2201/402* (2013.01); *B66B 2201/4638* (2013.01)

(58) Field of Classification Search
CPC ..... B66B 1/2408; B66B 1/468; B66B 3/006; B66B 2201/223
USPC ..... 187/382
See application file for complete search history.

(56) References Cited

U.S. PATENT DOCUMENTS 5,260,527 A * 11/1993 Sirag, Jr. ..... B66B 1/2408 187/380
5,274,202 A * 12/1993 Kezer ..... B66B 1/2408 187/385
5,354,957 A * 10/1994 Robertson ..... B66B 1/2408 187/247
5,503,249 A * 4/1996 Virtamo ..... B66B 1/2458 187/380
6,394,232 B1 * 5/2002 Iwata ..... B66B 1/2458 187/247
7,014,015 B2 * 3/2006 Nikovski ..... B66B 1/2458 187/247
7,484,597 B2 * 2/2009 Nikovski ..... B66B 1/18 187/247

(Continued)

*Primary Examiner* — David Warren
(74) *Attorney, Agent, or Firm* — Steven M. Greenberg, Esq.; CRGO Law

(57) ABSTRACT

Embodiments of the present invention provide a method, system and computer program product for smart elevator car destination management according to probabilistic destination determination. In an embodiment of the invention, a method for smart elevator car destination management according to probabilistic destination determination includes predicting a set of passengers requesting use of an elevator car in a bank of elevator cars in a building and determining a probability for each of the passengers that each passenger will select as a destination a particular floor in the building. The method also includes grouping ones of the passengers in the set according to a common floor determined to be probable for the grouped ones of the passengers. Finally, the method includes displaying in connection with the bank of elevator cars an assignment of the grouped ones of the passengers to one of the elevator cars in the bank.

15 Claims, 2 Drawing Sheets

(56) References Cited

U.S. PATENT DOCUMENTS

| | | | | |
|---|---|---|---|---|
| 7,546,905 | B2 * | 6/2009 | Nikovski | B66B 1/18 187/247 |
| 8,220,591 | B2 * | 7/2012 | Atalla | B66B 1/20 187/383 |
| 8,584,811 | B2 * | 11/2013 | Kuoppala | B66B 1/468 187/316 |
| 9,302,885 | B2 * | 4/2016 | Christy | B66B 1/2408 |
| 9,834,405 | B2 * | 12/2017 | Nikovski | B66B 1/2458 |
| 2003/0221915 | A1 * | 12/2003 | Brand | B66B 1/2458 187/382 |
| 2004/0089503 | A1 * | 5/2004 | Brand | B66B 1/2458 187/383 |
| 2011/0155514 | A1 * | 6/2011 | Iwata | B66B 1/468 187/382 |
| 2011/0284329 | A1 * | 11/2011 | Nakagawa | B66B 1/2458 187/382 |
| 2013/0186713 | A1 * | 7/2013 | Suzuki | B66B 1/2408 187/385 |
| 2016/0083218 | A1 * | 3/2016 | Vuorenala | B66B 3/006 187/247 |
| 2016/0130112 | A1 * | 5/2016 | Nikovski | B66B 1/2458 187/247 |
| 2016/0292521 | A1 * | 10/2016 | Fang | B66B 1/2408 |
| 2016/0292522 | A1 * | 10/2016 | Chen | B66B 1/3476 |
| 2016/0295192 | A1 * | 10/2016 | Hsu | B66B 1/2408 |
| 2016/0295196 | A1 * | 10/2016 | Finn | G06T 7/11 |

* cited by examiner

ELEVATOR MANAGEMENT ACCORDING TO PROBABILISTIC DESTINATION DETERMINATION

BACKGROUND OF THE INVENTION

Field of the Invention

The present invention relates to elevator routing and more particularly to smart elevator car management in a smart elevator system.

Description of the Related Art

Elevators have been known to exist since the modern era and generally refer to a type of vertical transportation that moves people or things between levels of a structure. Elevators are generally powered by electric motors that either drive traction cables or counterweight systems like a hoist, or pump hydraulic fluid to raise a cylindrical piston like a jack. Early versions of the elevator required manual operation in which the operator directed the movement of the elevator upwards or downwards and also actuated the opening and closing of one or more doors of the elevator.

Most commonly associated with a multi-story building, the modern elevator car generally provides a small to mid-sized space accessible by a sliding door through which individuals may enter and egress the car. A control system allows individuals at a particular level of a building serviced by the car or a bank of cars, to summon a car to travel in an upwards or downwards direction from the floor at which the request was initiated. As well, the control system allows individuals once having entered a car to select a floor to which the individual desires to travel.

While traditional elevators largely respond ad hoc to the individual requests of those seeking access to the elevator, smart elevator systems provide intelligence as to the utilization of a bank of elevator cars so as to optimize the utilization of the bank of elevator cars. Examples of smart elevator systems include systems which attempt to group individuals seeking access to the same floor in a single elevator car. Other examples of smart elevator systems include systems which account for the disabilities of certain travelers to ensure that the most appropriate car is allocated to the individual with disabilities.

BRIEF SUMMARY OF THE INVENTION

Embodiments of the present invention address deficiencies of the art in respect to smart elevator systems and provide a novel and non-obvious method, system and computer program product for smart elevator car destination management according to probabilistic destination determination. In an embodiment of the invention, a method for smart elevator car destination management according to probabilistic destination determination includes predicting a set of passengers requesting use of an elevator car in a bank of elevator cars in a building and determining a probability for each of the passengers that each passenger will select as a destination a particular floor in the building. The method also includes grouping ones of the passengers in the set according to a common floor determined to be probable for the grouped ones of the passengers. Finally, the method includes displaying in connection with the bank of elevator cars an assignment of the grouped ones of the passengers to one of the elevator cars in the bank.

In one aspect of the embodiment, the set of passengers is predicted by detecting a sensor affixed to each of the passengers in proximity to the bank of elevator cars. In another aspect of the embodiment, the set of passengers is predicted based upon different calendar entries indicating meeting times within the building for each of the passengers. In yet another aspect of the embodiment, the probability of selecting as a destination a particular floor in the building is determined for a specific one of the passengers based upon a frequency of past selections of particular floors in the building by the specific one of the passengers. Finally, in even yet another aspect of the embodiment, the probability of selecting as a destination a particular floor in the building is determined for a specific one of the passengers in reference to a calendar entry in a corresponding calendar of the specific one of the passengers indicating a meeting at a particular time on a particular floor in the building.

In another embodiment of the invention, a smart elevator data processing system is configured for smart elevator car destination management according to probabilistic destination determination. The system includes a host computing platform with one or more computers, each with memory and at least one processor. The system also includes a display coupled to the host computing platform and disposed in proximity to a bank of elevator cars in a building. Finally, the system includes a smart elevator car destination management module executing in the memory of the host computing platform. The module includes program code enabled during execution in the memory of the host computing platform to predict a set of passengers requesting use of an elevator car in the bank of elevator cars in the building, to determine a probability for each of the passengers that each passenger will select as a destination a particular floor in the building, to group ones of the passengers in the set according to a common floor determined to be probable for the grouped ones of the passengers and to displaying in the display an assignment of the grouped ones of the passengers to one of the elevator cars in the bank.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for smart elevator car destination management according to probabilistic destination determination. In accordance with an embodiment of the invention, a selection of individuals who are likely to utilize an elevator car in a bank of elevator cars of a building of multiple floors are identified. For instance, a calendar of one or more of the individuals may be consulted to detect a scheduled event at one of the floors at a particular time. As another example, the presence of one or more of the individuals may be sensed in proximity to the bank of elevator cars. Thereafter, a probability of each of the individuals requesting a stop at a particular one of the floors is determined. For example, a past selection of one or more of the floors by each of the different individuals may be consulted so as to indicate a likelihood of each different individual contemporaneously selecting a floor. Alternatively, the calendar of one or more of the different individuals may be consulted. Then, ones of the individuals are grouped into different groups for different ones of the cars so as to minimize a number of stops at different ones of the floors by the cars in the bank.

Figure 1:
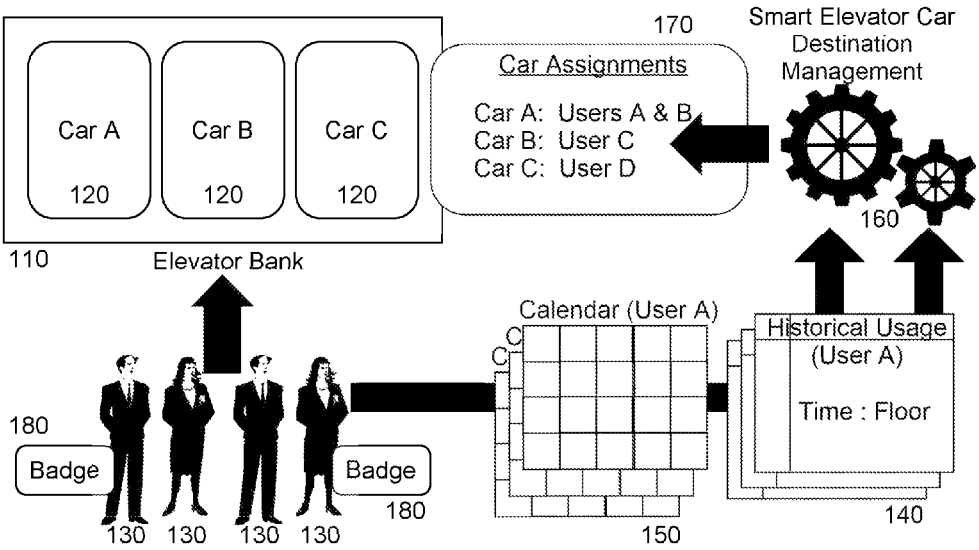
FIG. 1 is a pictorial illustration of a process for smart elevator car destination management according to probabilistic destination determination.

In illustration, FIG. 1 pictorially shows a process for smart elevator car destination management according to probabilistic destination determination. As shown in FIG. 1, smart elevator car destination management logic 160 predicts a set of different passengers 130 to utilize a bank 110 of elevator cars 120 to reach different floors in a building. The smart elevator car destination management logic 160 predicts the set of different passengers 130, for instance, in reference to a table of historical usage 140 of the bank 110 of elevator cars 120, or as another example, in reference to the different calendars 150 of the different passengers 130.

In the former instance, the smart elevator car destination management logic 160 may consult the table of historical usage 140 to locate past times and destinations of usage of the bank 110 of the cars 120 by the passengers 130 so as to identify a pattern of utilization indicative of future utilization of the bank 110 of the cars 120 by the passengers 130. In the latter instance, the smart elevator car destination management logic 160 may consult the calendar 150 of each of the passengers to locate an impending appointment for one of the passengers 130 on a particular floor of the building so as to predict the necessity of the one of the passengers 130 to utilize one of the cars 120 of the bank 110. As yet another possibility, the smart elevator car destination management logic 160 may sense the presence of the passengers 130 in proximity to the bank 110 of elevator cars 120 by sensing an RFID tag 180 affixed to a corresponding one of the passengers 130, or optionally a mobile device such as a smart phone associated with a corresponding one of the passengers 130.

Once the smart elevator car destination management logic 160 predicts the set of passengers 130, the smart elevator car destination management logic 160 then determines a probability of each of the passengers 130 to request transport to a particular one of the floors of the building. The smart elevator car destination management logic 160 determines the probability of each of the passengers 130 to request transport to a particular one of the floors of the building in reference to past patterns evident from the table of historical usage 140 and by the respective calendars 150 of the different passengers 130. Once the smart elevator car destination management logic 160 has determined the probabilities of each of the passengers 130 requesting a particular one of the floors of the building, the smart elevator car destination management logic 160 then groups ones of the passengers 130 together with common floors likely to be requested based upon the determined probabilities and assigns each grouping to a different one of the cars 120 in the bank 110. The smart elevator car destination management logic 160 then displays those assignments in a display 170 in connection with the elevator bank 110.

Figure 2:
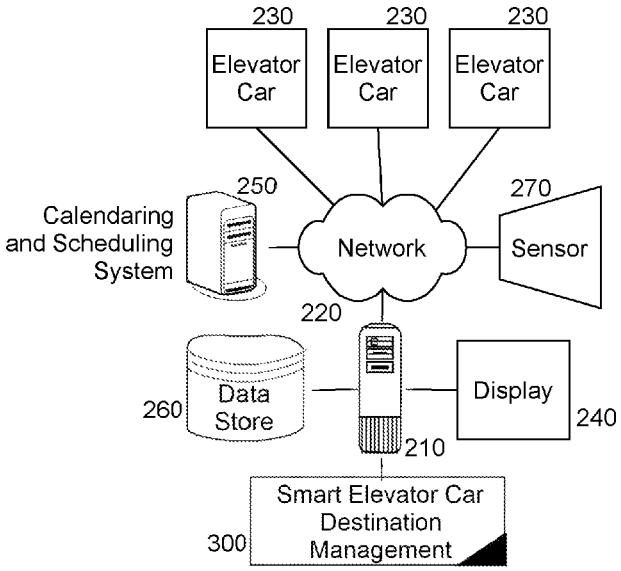
FIG. 2 is a schematic illustration of a smart elevator data processing system configured for smart elevator car destination management according to probabilistic destination determination; and, FIG. 3 is a flow chart illustrating a process for smart elevator car destination management according to probabilistic destination determination.

The process described in connection with FIG. 1 may be implemented in a smart elevator data processing system. In further illustration, FIG. 2 schematically illustrates a smart elevator data processing system configured for smart elevator car destination management according to probabilistic destination determination. The system includes a host computing platform 210 that includes one or more computers, each with memory and at least one processor. The host computing platform 210 is communicatively coupled to different elevator cars 230 of an elevator bank over computer communications network 220. The host computing platform 210 also is communicatively coupled to a calendaring and scheduling system 250 as well as at least one sensor 270 enabled to sense the presence of an RFID badge.

A smart elevator car destination management module 300 executes in the memory of the host computing platform 210. The module 300 includes program code enabled upon execution in the memory of the host computing platform 210 to predict a set of passengers intending to utilize the elevator cars 230 to transport the passengers to different floors of a building. The program code is enabled to do so, for instance, by sensing through sensor 270 the presence of one or more passengers. Alternatively, the program code is enabled to do so in reference to a table of historical usage by different passengers disposed in data store 260, or in reference to calendaring and scheduling information for the different passengers disposed in the calendaring and scheduling system 250.

The program code of the smart elevator car destination management logic 160 also is enabled to determine a probability that each of the different passengers will select a particular one of the floors of the building once in a corresponding one of the elevator cars 230. The program code determines the probability in reference to the table of historical usage by different passengers disposed in the data store 260, or in reference to calendaring and scheduling information for the different passengers disposed in the calendaring and scheduling system 250. Finally, the program code of the smart elevator car destination management logic 160 groups ones of the passengers with probabilistically common floors for assignment to a same one of the elevator cars 230.

Figure 3:
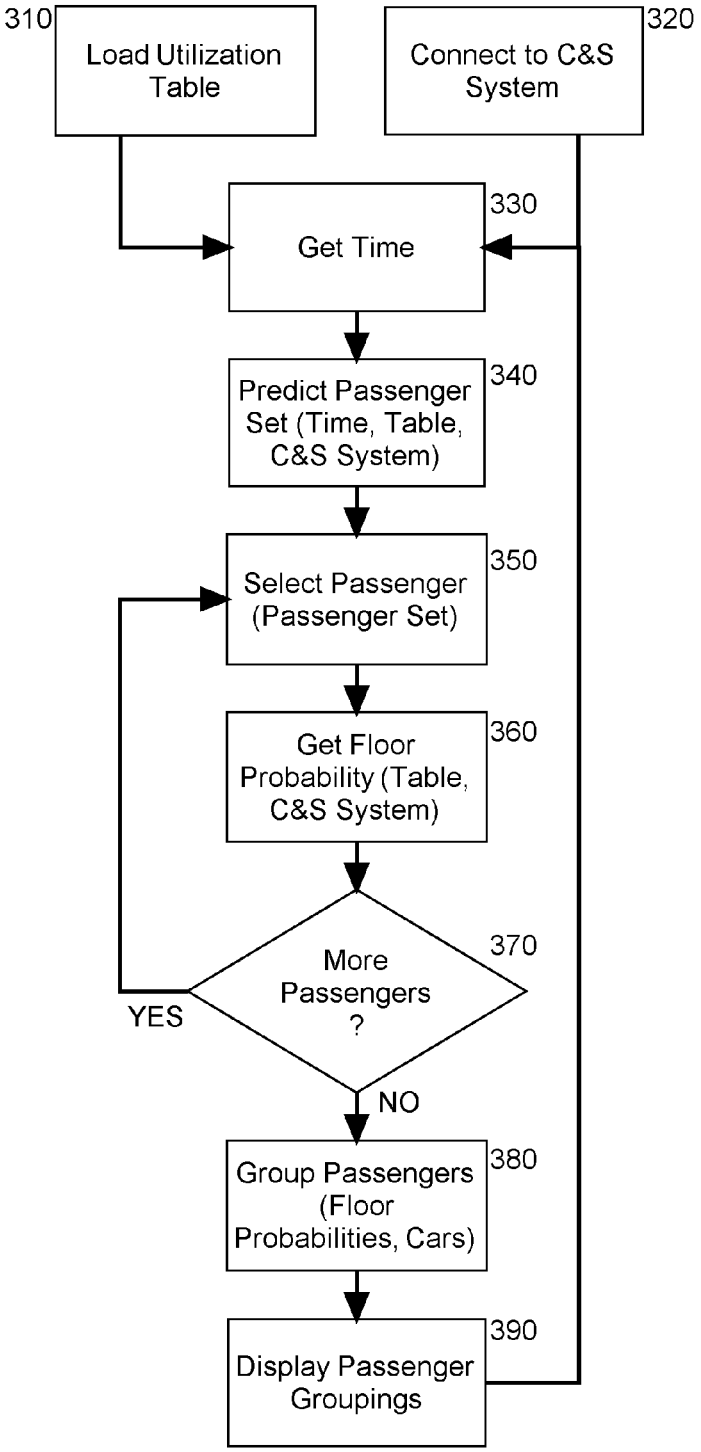

In even yet further illustration of the operation of the smart elevator car destination management logic 160, FIG. 3 is a flow chart illustrating a process for smart elevator car destination management according to probabilistic destination determination. Beginning in block 310, a table of historical usage is loaded into memory containing individual records of previous utilization of different ones of the elevator cars at different times on different days in connection with different floors of the building. As well, in block 320 a connection is established between the smart elevator car destination management logic and a remotely disposed calendaring and scheduling system. Thereafter, a current time of day is determined in block 330.

In block 340, a set of passengers proximate to the bank of elevators is predicted based upon the current time, the table of historical usage and calendaring information in the calendaring and scheduling system. Thereafter, in block 350 a first passenger in the set is selected for processing and in block 360, a probability of the first passenger selecting a particular floor in the building is determined based upon the table of historical usage and the calendaring information in the calendaring and scheduling system.

In decision block 370, it is then determined if additional passengers remain to be processed in the set. If so, the process returns to block 350. When no further passengers remain to be processed in the set, in decision block 380 different ones of the passengers in the set are grouped together according to common floors probabilistically likely to be selected by the grouped passengers. The grouped together passengers are then assigned to a particular one of the elevator cars of the banks and in block 390 the assignments of the different groupings are displayed.

The present invention may be embodied within a system, a method, a computer program product or any combination thereof. The computer program product may include a computer readable storage medium or media having computer readable program instructions thereon for causing a processor to carry out aspects of the present invention. The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing.

A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A method for smart elevator car destination management according to probabilistic destination determination, the method comprising:

predicting a set of passengers requesting use of an elevator car in a bank of elevator cars in a building;

determining a probability for each of the passengers that each passenger will select as a destination a particular floor in the building;

grouping ones of the passengers in the set according to a common floor determined to be probable for the grouped ones of the passengers; and, displaying in connection with the bank of elevator cars an assignment of the grouped ones of the passengers to one of the elevator cars in the bank.

2. The method of claim 1, wherein the set of passengers is predicted by detecting a sensor affixed to each of the passengers in proximity to the bank of elevator cars.

3. The method of claim 1, wherein the set of passengers is predicted based upon different calendar entries indicating meeting times within the building for each of the passengers.

4. The method of claim 1, wherein the probability of selecting as a destination a particular floor in the building is determined for a specific one of the passengers based upon a frequency of past selections of particular floors in the building by the specific one of the passengers.

5. The method of claim 1, wherein the probability of selecting as a destination a particular floor in the building is determined for a specific one of the passengers in reference to a calendar entry in a corresponding calendar of the specific one of the passengers indicating a meeting at a particular time on a particular floor in the building.

6. A smart elevator data processing system configured for smart elevator car destination management according to probabilistic destination determination, the system comprising:

a host computing platform comprising one or more computers, each with memory and at least one processor;

a display coupled to the host computing platform and disposed in proximity to a bank of elevator cars in a building; and, a smart elevator car destination management module executing in the memory of the host computing platform, the module comprising program code enabled during execution in the memory of the host computing platform to predict a set of passengers requesting use of an elevator car in the bank of elevator cars in the building, to determine a probability for each of the passengers that each passenger will select as a destination a particular floor in the building, to group ones of the passengers in the set according to a common floor determined to be probable for the grouped ones of the passengers and to displaying in the display an assignment of the grouped ones of the passengers to one of the elevator cars in the bank.

7. The system of claim 6, wherein the set of passengers is predicted by detecting a sensor affixed to each of the passengers in proximity to the bank of elevator cars.

8. The system of claim 6, wherein the set of passengers is predicted based upon different calendar entries indicating meeting times within the building for each of the passengers.

9. The system of claim 6, wherein the probability of selecting as a destination a particular floor in the building is determined for a specific one of the passengers based upon a frequency of past selections of particular floors in the building by the specific one of the passengers.

10. The system of claim 6, wherein the probability of selecting as a destination a particular floor in the building is determined for a specific one of the passengers in reference to a calendar entry in a corresponding calendar of the specific one of the passengers indicating a meeting at a particular time on a particular floor in the building.

11. A computer program product for smart elevator car destination management according to probabilistic destination determination, the computer program product comprising a computer readable storage medium having program instructions embodied therewith, the program instructions executable by a device to cause the device to perform a method comprising:

predicting a set of passengers requesting use of an elevator car in a bank of elevator cars in a building;

determining a probability for each of the passengers that each passenger will select as a destination a particular floor in the building;

grouping ones of the passengers in the set according to a common floor determined to be probable for the grouped ones of the passengers; and, displaying in connection with the bank of elevator cars an assignment of the grouped ones of the passengers to one of the elevator cars in the bank.

12. The computer program product of claim 11, wherein the set of passengers is predicted by detecting a sensor affixed to each of the passengers in proximity to the bank of elevator cars.

13. The computer program product of claim 11, wherein the set of passengers is predicted based upon different calendar entries indicating meeting times within the building for each of the passengers.

14. The computer program product of claim 11, wherein the probability of selecting as a destination a particular floor in the building is determined for a specific one of the passengers based upon a frequency of past selections of particular floors in the building by the specific one of the passengers.

15. The computer program product of claim 11, wherein the probability of selecting as a destination a particular floor in the building is determined for a specific one of the passengers in reference to a calendar entry in a corresponding calendar of the specific one of the passengers indicating a meeting at a particular time on a particular floor in the building.

* * * * *